US010980280B2

(12) United States Patent
Morningstar

(10) Patent No.: US 10,980,280 B2
(45) Date of Patent: Apr. 20, 2021

(54) VAPE PEN COVER

(71) Applicant: James Morningstar, West Palm Beach, FL (US)

(72) Inventor: James Morningstar, West Palm Beach, FL (US)

( * ) Notice: Subject to any disclaimer, the term of this patent is extended or adjusted under 35 U.S.C. 154(b) by 226 days.

(21) Appl. No.: 16/162,369

(22) Filed: Oct. 16, 2018

(65) Prior Publication Data

US 2020/0113238 A1 Apr. 16, 2020

(51) Int. Cl.

| | |
|---|---|
| ***A24F 47/00*** | (2020.01) |
| ***A24F 9/16*** | (2006.01) |
| ***A24F 40/40*** | (2020.01) |

(52) U.S. Cl.

CPC ..... *A24F 47/008* (2013.01); *A24F 9/16* (2013.01); *A24F 40/40* (2020.01)

(58) Field of Classification Search

CPC ..... B43K 23/08; B43K 23/10; B43K 23/12; B43K 23/124; B43K 23/126; B43K 25/02; B43K 25/022; B43K 25/024; A61M 15/0025; A61M 15/06; A24F 9/16; A24F 15/12; A24F 40/00; A24F 40/05; A24F 40/10; A24F 40/20; A24F 40/30; A24F 40/70; A24F 47/00; A24F 47/002; A24F 47/004; A24F 47/006; A24F 47/008; A24F 40/40; B65D 41/0471; B65D 43/0214;

(Continued)

(56) References Cited

U.S. PATENT DOCUMENTS 634,013 A * 10/1899 Mitchell ..... B43K 23/12 401/243
1,277,097 A * 8/1918 Seaton ..... C21D 9/663 432/199

(Continued)

FOREIGN PATENT DOCUMENTS

FR 945832 A * 5/1949 ..... B43K 23/12
FR 1193771 A * 11/1959 ..... B43K 23/126

(Continued)

OTHER PUBLICATIONS

CloudV NPL (https://vaporsmooth.com/discreet-vape-pen-looks-like-pen/ captured Sep. 18, 2017) (Year: 2017).*

(Continued)

*Primary Examiner* — Kathryn E Ditmer
(74) *Attorney, Agent, or Firm* — Lamon Patent Services; Cynthia S. Lamon

(57) ABSTRACT

A cover for a vape pen has a cylindrical body having a closed and an open end, a length substantially shorter than a vape pen to be covered, an outside diameter, and an inside diameter greater than an outside diameter and dimensions of a mouthpiece of the vape pen to be covered, a pocket clip affixed to the outside diameter, aligned in a direction of the length of the cylindrical body, and directed such that in use the closed end of the cylindrical body is uppermost, and an insert affixed to the inside diameter of the cylindrical body, around a circumference of the inside diameter, the insert presenting a plurality of flexible protuberances each of a length less than a radius of the cylindrical body, with each directed radially inward from the inside diameter of the cylindrical body.

4 Claims, 4 Drawing Sheets

(58) Field of Classification Search
CPC ..... B65D 43/08; A42F 42/00; A42F 42/10; A42F 42/20; A42F 42/60; A42F 42/80
See application file for complete search history.

(56) References Cited

U.S. PATENT DOCUMENTS

| | | | | | |
|---|---|---|---|---|---|
| 2,278,907 | A * | 4/1942 | Baker | B43K 23/126 | 401/247 |
| 2,312,069 | A * | 2/1943 | Baumgartner | B43K 23/10 | 401/98 |
| 2,438,231 | A | 3/1948 | Schultz et al. | | |
| 4,516,869 | A | 5/1985 | Corpataux | | |
| 5,114,258 | A * | 5/1992 | Yasunaga | B43K 23/124 | 24/11 F |
| 5,230,578 | A * | 7/1993 | Fuhrmann, III | B43K 23/124 | 401/202 |
| 5,492,248 | A * | 2/1996 | Ortner | A45D 34/02 | 222/78 |
| 5,747,748 | A * | 5/1998 | Zigler | B43K 23/10 | 178/18.01 |
| 6,435,749 | B1 * | 8/2002 | Lecce | B43K 23/12 | 24/10 R |
| 2008/0021072 | A1 * | 1/2008 | Luzenberg | A24F 47/002 | 514/343 |
| 2017/0056614 | A1 * | 3/2017 | Thuet | A61M 15/06 | |
| 2017/0119044 | A1 | 5/2017 | Oligschlaeger et al. | | |
| 2018/0007958 | A1 * | 1/2018 | Verbiest | A24F 15/12 | |
| 2019/0104768 | A1 * | 4/2019 | Domenici | A61M 15/0036 | |
| 2020/0093174 | A1 * | 3/2020 | Smedberg | A24F 1/32 | |

FOREIGN PATENT DOCUMENTS

| | | | | |
|---|---|---|---|---|
| FR | 1419530 | A * | 11/1965 | B43K 23/12 |
| FR | 2739591 | A1 * | 4/1997 | B43M 99/008 |

OTHER PUBLICATIONS

Additional CloudV images from google images (Year: 2020).*
KandyPens (https://www.kandypens.com/special-k-white-vaporizer.html captured Mar. 13, 2018) (Year: 2018).*
Innokin LEA (as reviewed on https://stevevape.com/innoken-lea/ on Jun. 27, 2011) (Year: 2011).*

* cited by examiner

VAPE PEN COVER

BACKGROUND OF THE INVENTION

1. Field of the Invention

The present invention is in the technical area of vapor-producing apparatus and pertains more particularly to an all-purpose cover for enclosing a vaporizing pen, henceforth a vape pen.

2. Description of Related Art

Vaporizing pens for vaporizing dry flower *cannabis*, tobacco and other liquid *cannabis* concentrates or other products are very well known in the art. Moreover, such apparatus is legal in some states, and a trend is to legalization in more states. Carrying a vape pen visible to others in a state where the use of *cannabis* and such apparatus is illegal, can lead to legal problems, and may also be a problem even in states where legal, because there is a sizable population that looks down on such apparatus and use.

Vape pens typically have a mouthpiece for intake/inhaling the vape mist or smoke, and there is no cover commonly sold with vape pens. Size and shape of mouthpieces may periodically change design for a given vape pen. An individual also may own a plurality of vape pens with different shaped mouth pieces. Orientation is important when carrying a vape pen, because the burner is below the concentrate cartridge towards the proximal end away from the mouthpiece, so it is important to always carry the pen with the mouth piece up so gravity keeps the viscous liquid product near the burner. Additionally, having exposed mouthpieces may become infected by various pathogens.

What is clearly needed is a versatile vape pen cover that fits various sized vape pen mouthpieces and looks like a writing pen cap, so when the vape pen is carried in a pocket of a garment, such as a shirt pocket, with the mouthpiece up, with the versatile cover over the mouthpiece, the apparatus assumes the appearance of a writing pen.

BRIEF SUMMARY OF THE INVENTION

In one embodiment of the invention a cover for a vape pen is provided, comprising a cylindrical body having a closed and an open end, a length substantially shorter than a vape pen to be covered, an outside diameter, and an inside diameter greater than an outside diameter and dimensions of a mouthpiece of the vape pen to be covered, a pocket clip affixed to the outside diameter, aligned in a direction of the length of the cylindrical body, and directed such that in use the closed end of the cylindrical body is uppermost, and an insert affixed to the inside diameter of the cylindrical body, around a circumference of the inside diameter, the insert presenting a plurality of flexible protuberances each of a length less than a radius of the cylindrical body, with each directed radially inward from the inside diameter of the cylindrical body.

In one embodiment the cover further comprises a small vent opening in the closed end of the cylindrical body. Also, in one embodiment the insert comprises a sheet of rubberlike material having a length substantially less than the length of the cylindrical body, a width equal to a circumference of the inside diameter of the cylindrical body, and flexible protuberances extending orthogonally from one surface of the sheet, such that the sheet may be rolled into a circular shape with the protuberances directed radially inward, and may be inserted into the inside of the cylindrical body and held in place by an adhesive.

In another aspect of the invention a method is provided for protecting and carrying a vape pen having a mouthpiece for ingesting vapor from the vape pen, comprising forming a cover comprising a cylindrical body having a closed and an open end, a length substantially shorter than the vape pen, an outside diameter, and an inside diameter greater than an outside diameter and dimensions of a mouthpiece, affixing a pocket clip to the outside diameter of the cylindrical body, aligned in a direction of the length of the cylindrical body, and directed such that in use the closed end of the cylindrical body is uppermost, forming an insert comprising a sheet of rubberlike material having a length substantially less than the length of the cylindrical body, a width equal to a circumference of the inside diameter of the cylindrical body, and flexible protuberances extending orthogonally from one surface of the sheet, rolling the sheet into a circular shape with the protuberances directed radially inward, inserting the sheet, rolled, into the inside of the cylindrical body, and affixing the sheet by an adhesive, placing the cover by the open end over the mouthpiece and part of the upper length of the vape pen, such that the flexible protuberances contact and hold the cover in place on the vape pen, and placing the covered vape pen, mouthpiece and cover uppermost, into a pocket of a garment, clipping the pocket clip to a portion of the packet to hold the covered vape pen in place.

DETAILED DESCRIPTION OF THE INVENTION

Figure 1A:
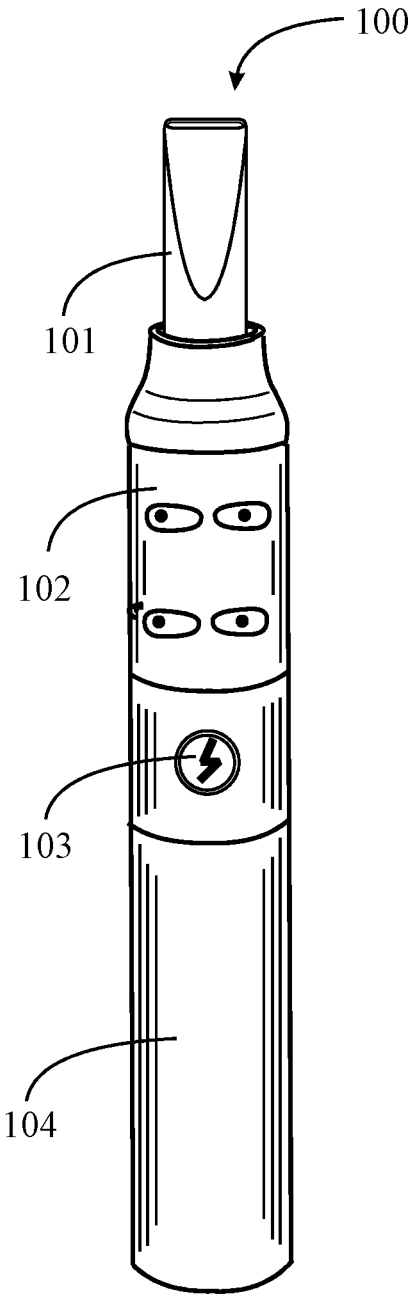
Fig. 1A (Prior Art)
FIG. 1A is an elevation view of an exemplary vape pen in prior art.
Figure 1B:
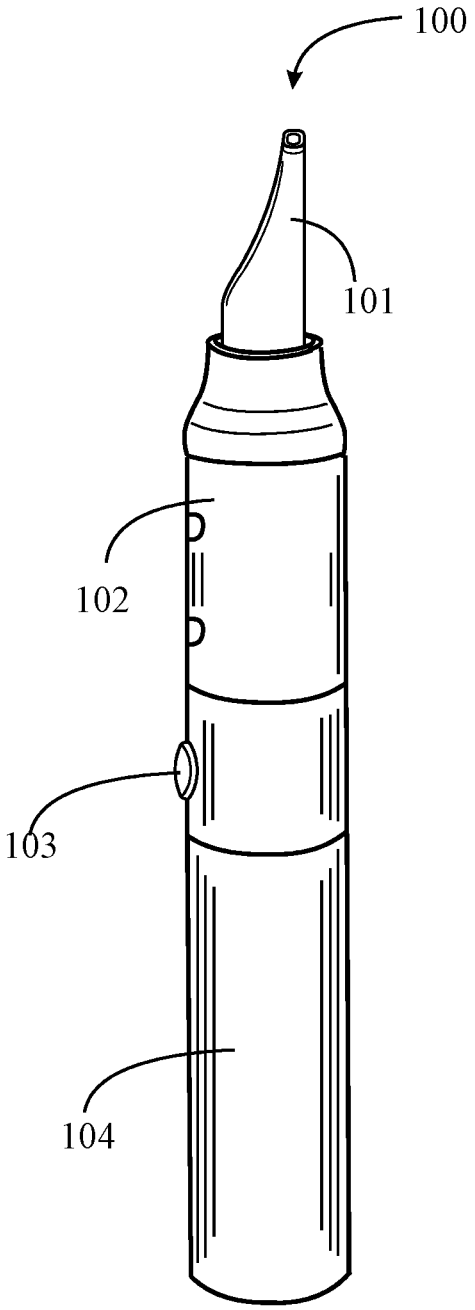
Fig. 1B (Prior Art)
FIG. 1B is an elevation view of the vape pen of FIG. 1A, rotated ninety degrees.

FIG. 1A is an elevation view of an exemplary vape pen 100 in prior art, and FIG. 1B is an elevation view of the vape pen of FIG. 1A rotated ninety degrees around the long axis. The skilled person will immediately realize that this example is but one of many designs of vape pens currently available. Vape pens, however, typically have essentially the same elements, and the inventor believes that the vape pen illustrated in FIGS. 1A and 1B is sufficient for description of the present invention.

Vape pen 100 comprises a mouthpiece 101, seen better in the rotated view 1B in a typical flattened aspect, and the user inserts this mouthpiece into the mouth to draw vapor from the vape pen. The mouthpiece may be cylindrical to the end and not flattened as shown in FIG. 1B. Alternatively, the mouthpiece may be oval. There are many variations and shapes of a given mouthpiece. A section 102 in this example houses a refillable reservoir of *cannabis* or other product capable of vaporization buy the vape pen, and a vaporizing apparatus using heat to vaporize. Section 104 houses a battery as a power supply for heating the product in the vaporizing apparatus 100, to provide vapor at mouthpiece 101. A button 103 is a switch input for applying power to the vaporizing apparatus to cause product to be vaporized.

A user may wish to carry the vape pen on one's person when moving about, and in so doing, it is important to keep the vape pen upright so that mouthpiece 101 is uppermost, so gravity keeps the viscous *cannabis* product near the burner. Additionally, the vape end may be carried in a purse, vehicle or on one's desk.

Figure 2C:
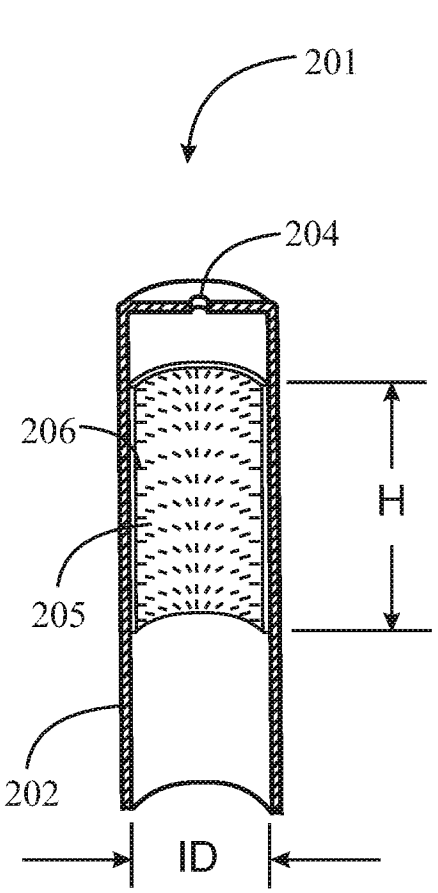
FIG. 2C is a section view of the vape pen cover of FIGS. 2A and 2B in section taken along section line 2C-2C of FIG. 2B.
Figure 2B:
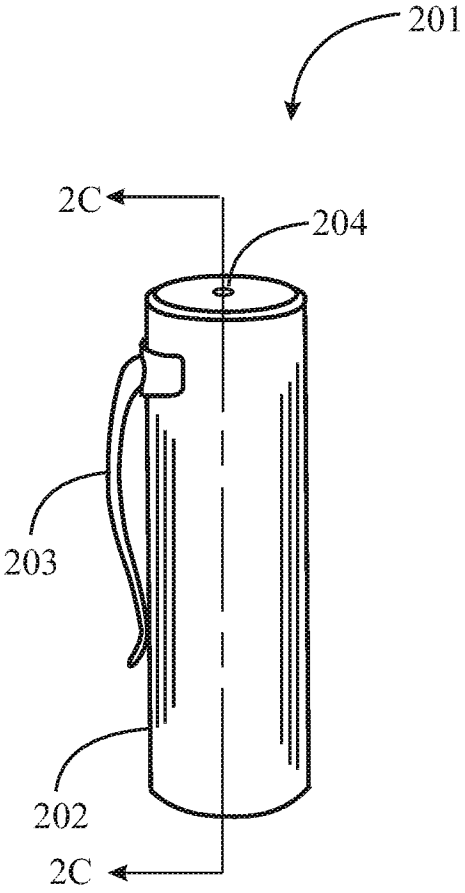
FIG. 2B is an elevation view of the vape pen cover of FIG. 2A, rotated ninety degrees.
Figure 2A:
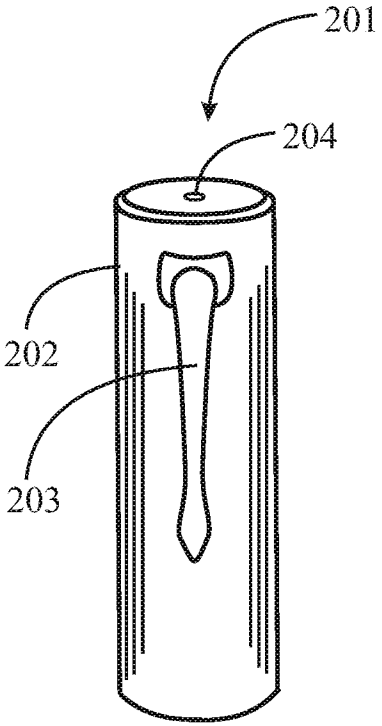
FIG. 2A is an elevation view of a vape pen cover in an embodiment of the invention.

FIG. 2A is an elevation view of a vape pen cover 201 in an embodiment of the invention. Cover 201 has a body 202 that is open on the lower end (not seen) and closed at the upper end, except for a small hole 204 in some embodiments, with a purpose of avoiding air lock when the cover may be placed over a vape pen. A clip 203 is affixed to body 202 near an upper end and is used to clip the vape pen cover to a user's pocket flap in many use cases, such as carrying a vape pen in a shirt pocket, for example.

FIG. 2B is an elevation view of the vape pen cover of FIG. 2A, rotated ninety degrees to show further detail of the clip 203. The skilled person will realize that clip 203 may be implemented in a variety of different ways for the same purpose.

FIG. 2C is a section view of the vape pen cover of FIGS. 2A and 2B in section taken along section line 2C-2C of FIG. 2B. Clip 203 is not seen in FIG. 2C, being on the back of the section shown. A portion of an insert 205, adhered to an inner wall of body 202 is seen in FIG. 2C. This insert is made, in this embodiment from a flat sheet of flexible, rubberlike material with a plurality of protrusions 206 extending from an inner surface of the sheet, pointing generally toward a center axis of the vape pen cover. In FIG. 2C body 202 is seen to have an inner diameter (ID) and insert 205 is seen to have a height H in the direction of the axis of the body 202.

Figure 3:
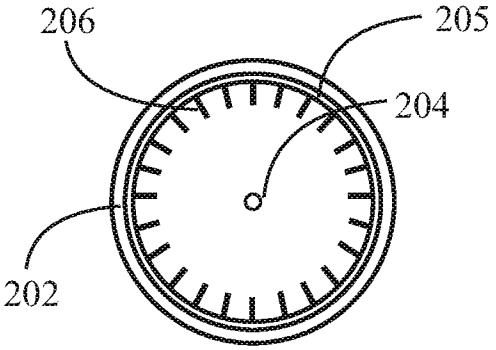
FIG. 3 is a view directly into the open end of the vape pen cover of FIG. 2B.

FIG. 3 is a view directly into the open end of vape pen cover 201 of FIG. 2B. Insert 205 is seen in this view as formed around the inside diameter of body 202, with protuberances 206 extending generally toward the center axis. An important purpose of the flexible protuberances 206 is to enable vape pen cover 201 to be used with vape pens and mouthpieces of different sizes and diameters. When a user places the vape pen cover 201 over a vape pen, like vape pen 100 of FIGS. 1A and 1B, protuberances 206 will contact outer surfaces of the vape pen and tend to hold the vape pen securely. In this relationship, when one lifts a vape pen, covered with a vape pen cover, from a pocket, the two will come out together, and the cover will not release unintentionally.

The protuberances 206 may be of varying heights and not all of the same height. Additionally, the protuberances may not be placed in a uniform grid manner, as shown, but randomly spaced. For example, the protuberances 206 may be longer towards the closed end, up to twice as long in order to engage and hold the mouthpiece 101 at the flattened area. Alternatively, all of the protuberances are the same height enabled to engage the mouth piece at the flattened area of mouthpiece 101. The protuberances hold onto the mouthpiece by mechanical engagement and friction. Static electricity generated between the surface of the pen mouthpiece and the protuberances may serve to adhere the vape pen cover 201 to the mouthpiece 101, as well.

Figure 4:
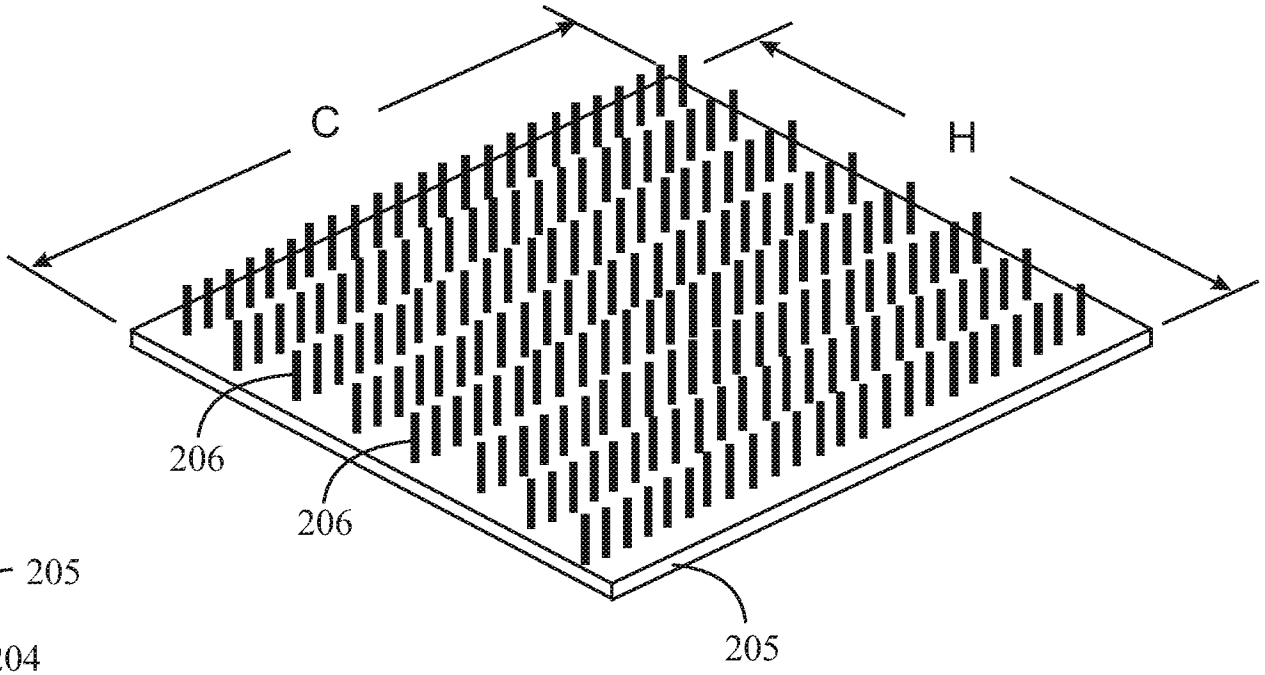
FIG. 4 is a perspective view of an internal element of the vape pen cover of FIGS. 2A, 2B and 2C.

FIG. 4 is a perspective view of insert 205 of the vape pen cover of FIGS. 2A, 2B and 2C, in a flat sheet aspect, which in some embodiments is the aspect in a stage of manufacture. Insert 205 is seen to have dimensions H and C. H is the height as seen in FIG. 2C. C is a circumference of the inner diameter of the vape pen cover. Mathematically C is ID×pi.

A plurality of rows of protuberances 206 is shown, in this example, in even rows and columns. This is simply an example, and in alternative embodiments such protuberances may have essentially any even or random order and spacing. An insert with protuberances may be manufactured in some embodiments by starting with a sheet of a thickness equal to the full height including the protuberances and removing material selectively to leave protuberances extending from a surface. The removal may be done in some cases mechanically, and is some cases chemically, and in other cases by heat forming. In another alternative a heat formable material may be pressed against a mold having a pattern of holes of a specific common depth, and material may be heat formed into the holes to produce the protuberances. There are many possibilities.

In different embodiments the protuberances may be of different shaped, thicknesses and cross-sectional shape, and there is no limitation on shapes and sizes. The protuberances may be round, square, hexagonal, or any other shape, and may be of differing lengths in different embodiments, or in one embodiment.

Figure 5:
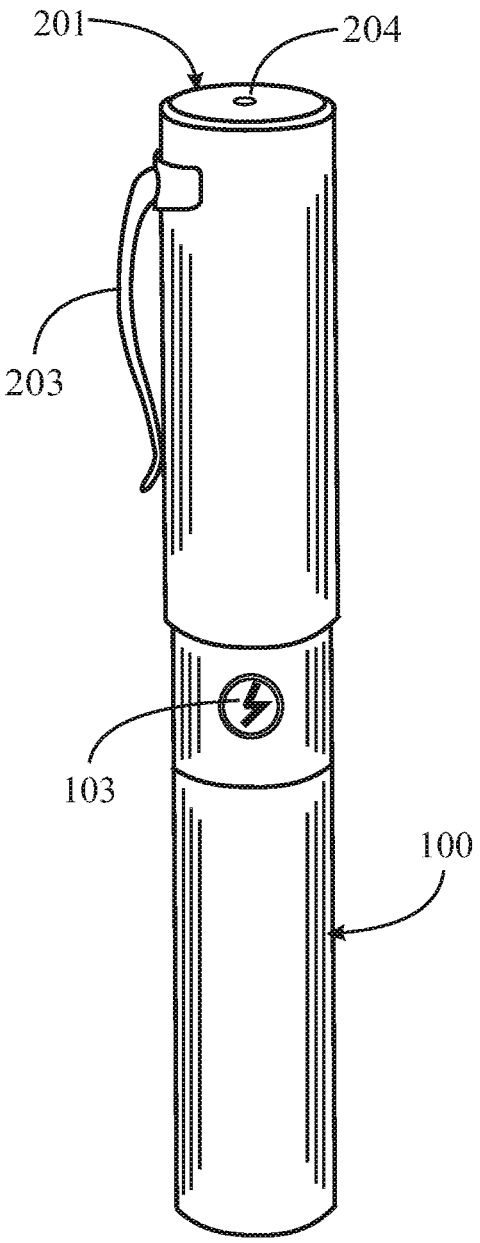
FIG. 5 is an elevation view of a vape pen with a vape pen cover in place according to an embodiment of the invention.

FIG. 5 is an elevation view of a vape pen 101 with a vape pen cover 201 according to an embodiment of the invention in place. A user may carry the cover 201 in any convenient location, a pocket or a purse, for example, and when needed the user may place the cover on the vape pen simply by slipping the cover over the mouthpiece end of the pen. The vape pen with cover may then be carried in a pocket, like a shirt pocket, or a pocket protector, with the mouthpiece of the vape pen uppermost.

The skilled person will understand that the embodiments described are exemplary, and that there may be a variety of alternative treatments all falling within the scope of the invention. The breadth of the invention is limited only by the scope of the claims that follow.

I claim:

1. A cover for a vape pen, comprising:

a cylindrical body having a closed end and an open end, a length substantially shorter than a vape pen to be covered, an outside diameter, and an inside diameter greater than an outside diameter of a mouthpiece of the vape pen to be covered;

a pocket clip affixed to the outside diameter, aligned in a direction of the length of the cylindrical body, and directed such that in use the closed end of the cylindrical body is uppermost; and an insert comprising a sheet of rubberlike material affixed to the inside diameter of the cylindrical body, around a circumference of the inside diameter, the insert presenting a plurality of flexible protuberances, equidistantly spaced from each other along a length and a width of the sheet and covering an entire surface of one side of the sheet, each protuberance having a height greater than a width, the height less than a radius of the cylindrical body, with each protuberance directed radially inward from an inside diameter of the insert.

2. The cover of claim 1 further comprising a small vent opening in the closed end of the cylindrical body.

3. The cover of claim 1 wherein the sheet is rolled into a cylindrical shape with the protuberances directed radially inward, and is inserted into the inside of the cylindrical body and held in place by an adhesive.

4. A method for protecting and carrying a vape pen having a mouthpiece for inhaling vapor from the vape pen, comprising:

forming a cover comprising a cylindrical body having a closed end and an open end, a length substantially shorter than the vape pen, an outside diameter, and an inside diameter greater than an outside diameter of the mouthpiece;

affixing a pocket clip to the outside diameter of the cylindrical body, aligned in a direction of the length of the cylindrical body, and directed such that in use the closed end of the cylindrical body is uppermost;

forming an insert comprising a sheet of rubberlike material having a length substantially less than the length of the cylindrical body, a width equal to a circumference of the inside diameter of the cylindrical body, and flexible protuberances equidistantly spaced from each other along the length and the width of the sheet and extending orthogonally from and completely covering one surface of the sheet, the protuberances each having a height greater than a width;

rolling the sheet into a circular shape with the protuberances directed radially inward, inserting the sheet, rolled, into the inside of the cylindrical body, and affixing the sheet by an adhesive;

placing the cover by the open end over the mouthpiece and part of the upper length of the vape pen, such that the flexible protuberances contact and hold the cover in place on the vape pen; and placing the covered vape pen, mouthpiece and cover uppermost, into a pocket of a garment, clipping the pocket clip to a portion of the pocket to hold the covered vape pen in place.

* * * * *